US012709836B2

(12) United States Patent
Kobashi et al.

(10) Patent No.: US 12,709,836 B2
(45) Date of Patent: Aug. 18, 2026

(54) ANTIBACTERIAL ACRYLIC ARTIFICIAL HAIR FIBERS, HAIR ORNAMENT PRODUCT INCLUDING SAME, AND METHOD FOR PRODUCING SAME

(71) Applicant: KANEKA CORPORATION, Osaka (JP)

(72) Inventors: Takaaki Kobashi, Takasago (JP); Akihiro Okamoto, Takasago (JP); Takeshi Tanaka, Takasago (JP)

(73) Assignee: KANEKA CORPORATION, Osaka (JP)

( * ) Notice: Subject to any disclaimer, the term of this patent is extended or adjusted under 35 U.S.C. 154(b) by 143 days.

(21) Appl. No.: 18/703,914

(22) PCT Filed: Sep. 26, 2022

(86) PCT No.: PCT/JP2022/035726

§ 371 (c)(1),
(2) Date: Apr. 23, 2024

(87) PCT Pub. No.: WO2023/074220

PCT Pub. Date: May 4, 2023

(65) Prior Publication Data

US 2024/0417916 A1 Dec. 19, 2024

(30) Foreign Application Priority Data

Oct. 28, 2021 (JP) ..... 2021-176285

(51) Int. Cl.

| | |
|---|---|
| ***D06M 15/03*** | (2006.01) |
| ***A41G 3/00*** | (2006.01) |
| ***D01F 6/40*** | (2006.01) |
| ***D06M 15/507*** | (2006.01) |
| ***D06M 15/53*** | (2006.01) |

(52) U.S. Cl.
CPC ..... *D06M 15/03* (2013.01); *A41G 3/00* (2013.01); *D01F 6/40* (2013.01); *D06M 15/507* (2013.01); *D06M 15/53* (2013.01)

(58) Field of Classification Search
CPC ..... A41G 3/00; A41G 3/0083; D01F 6/40; D01F 1/103; D06M 15/03; D06M 15/507; D06M 15/53; D06M 13/224
See application file for complete search history.

(56) References Cited

U.S. PATENT DOCUMENTS

| | | | |
|---|---|---|---|
| 6,524,508 | B1 | 2/2003 | Ohnishi et al. |
| 6,551,705 | B1 | 4/2003 | Ohnishi et al. |
| 2008/0003434 | A1 | 1/2008 | Kuroda et al. |
| 2021/0164130 | A1 | 6/2021 | Yoshikawa et al. |

FOREIGN PATENT DOCUMENTS

| | | | | | |
|---|---|---|---|---|---|
| GB | 2339717 | A | * | 2/2000 | ..... D06M 13/463 |
| JP | H10158978 | A | | 6/1998 | |
| JP | 2002227028 | A | | 8/2002 | |
| JP | 2006149510 | A | | 6/2006 | |
| WO | 9812369 | A1 | | 3/1998 | |
| WO | 2007094176 | A1 | | 8/2007 | |
| WO | 2020039704 | A1 | | 2/2020 | |

* cited by examiner

*Primary Examiner* — Lynda Salvatore
(74) *Attorney, Agent, or Firm* — Alleman Hall LLP

(57) ABSTRACT

One or more embodiments of the present invention relate to antibacterial acrylic artificial hair fibers containing chitosan and a nonionic surfactant, in which a content of the chitosan extracted with diluted acetic acid is 0.005% by weight to 0.4% by weight, or the content of the chitosan extracted with concentrated hydrochloric acid is 0.014% by weight to 1.2% by weight, a content of the nonionic surfactant is 0.10% by weight to 0.90% by weight, the nonionic surfactant is one or more selected from the group consisting of a polyoxyethylene sorbitan fatty acid ester, a polyoxyethylene fatty acid monoester, and a polyoxyethylene alkyl ether, and the nonionic surfactant has a hydrophilic-lipophilic balance (HLB) of 13.0 or more.

16 Claims, No Drawings

ANTIBACTERIAL ACRYLIC ARTIFICIAL HAIR FIBERS, HAIR ORNAMENT PRODUCT INCLUDING SAME, AND METHOD FOR PRODUCING SAME

TECHNICAL FIELD

One or more embodiments of the present invention relate to antibacterial acrylic artificial hair fibers used in hair ornament products such as hairpieces, hair ornament products including the same, and a method for producing the same.

BACKGROUND ART

Human hair or artificial hair have conventionally been used for hair ornament products such as hairpieces. However, in recent years, it has become difficult to obtain human hair. For this reason, there is a growing demand for artificial hair. Acrylic fibers, which have similar touch, gloss, and voluminousness to human hair, have been favorably used as artificial hair. For example, Patent Document 1 proposes artificial hair in which fibers, which are formed using an acrylic polymer containing acrylonitrile, a halogen-containing vinyl-based monomer such as vinyl chloride, and a vinyl-based monomer that is copolymerizable therewith, are used.

However, conventional acrylic artificial hair described in Patent Document 1 has poor antibacterial properties, and has a problem of generation or proliferation of bacteria when artificial hair is worn for a long period of time or when artificial hair is stored after it is worn.

Patent Document 2 proposes antibacterial acrylic fibers containing chitosan and a quaternary ammonium salt, as acrylic fibers used in clothing.

PRIOR ART DOCUMENTS

Patent Document

[Patent Document 1] JP 2002-227028A
[Patent Document 2] JP H10-158978A

DISCLOSURE OF INVENTION

Problem to be Solved by the Invention

Oils are applied to synthetic fibers in order to suppress static electricity or the like. However, when an oil is applied to acrylic fibers containing chitosan, the gloss deteriorates, making it difficult to use the acrylic fibers as artificial hair.

In order to solve the problems, one or more embodiments of the present invention provide acrylic artificial hair fibers having favorable antibacterial properties and gloss, hair ornament products including the same, and a method for producing the same.

Means for Solving Problem

One or more embodiments of the present invention relate to an antibacterial acrylic artificial hair fiber containing chitosan and a nonionic surfactant, in which a content of the chitosan extracted with diluted acetic acid is 0.005% by weight to 0.4% by weight, a content of the nonionic surfactant is 0.10% by weight to 0.90% by weight, the nonionic surfactant is one or more selected from the group consisting of a polyoxyethylene sorbitan fatty acid ester, a polyoxyethylene fatty acid monoester, and a polyoxyethylene alkyl ether, and the nonionic surfactant has an HLB of 13.0 or more.

One or more embodiments of the present invention relate to an antibacterial acrylic artificial hair fiber containing chitosan and a nonionic surfactant, in which a content of the chitosan extracted with concentrated hydrochloric acid is 0.014% by weight to 1.2% by weight, a content of the nonionic surfactant is 0.10% by weight to 0.90% by weight, the nonionic surfactant is one or more selected from the group consisting of a polyoxyethylene sorbitan fatty acid ester, a polyoxyethylene fatty acid monoester, and a polyoxyethylene alkyl ether, and the nonionic surfactant has an HLB of 13.0 or more.

One or more embodiments of the present invention relate to a hair ornament product containing the antibacterial acrylic artificial hair fibers.

One or more embodiments of the present invention relate to a method for producing the antibacterial acrylic artificial hair fibers, the method including wet-spinning a spinning solution containing an acrylic copolymer, in which chitosan and a nonionic surfactant are applied to the resulting filament before the filament is dried, and the nonionic surfactant has an HLB of 13.0 or more and is one or more selected from the group consisting of a polyoxyethylene sorbitan fatty acid ester, a polyoxyethylene fatty acid monoester, and a polyoxyethylene alkyl ether.

Effects of the Invention

According to the present invention, it is possible to provide antibacterial acrylic artificial hair fibers having favorable antibacterial properties and gloss, and hair ornament products including the same.

Also, using the production method according to the present invention, antibacterial acrylic artificial hair fibers having favorable antibacterial properties and gloss can be obtained through wet-spinning.

DESCRIPTION OF THE INVENTION

The inventors of the present invention repeatedly conducted studies regarding how to impart antibacterial properties to acrylic artificial hair fibers and improve gloss of artificial hair. As a result, the inventors of the present invention found that antibacterial acrylic artificial hair fibers having favorable antibacterial properties and gloss can be obtained by using, as an oil, one or more nonionic surfactants having a predetermined HLB and selected from the group consisting of a polyoxyethylene sorbitan fatty acid ester, a polyoxyethylene fatty acid monoester, and a polyoxyethylene alkyl ether, and setting the contents of chitosan and the nonionic surfactant to a predetermined range. Also, in one or more preferred embodiments of the present invention, the antibacterial acrylic artificial hair fibers have deodorization properties. Also, in one or more preferred embodiments of the present invention, the antibacterial acrylic artificial hair fibers have odor resistance.

In one or more embodiments of the present invention, a numerical range indicated by " . . . to . . . " includes two end values. For example, a numerical range indicated by "X to Y" includes the two end values of X and Y. Also, in this specification, when a plurality of numerical ranges are mentioned, the numerical ranges include appropriate combinations of upper and lower limits of different numerical ranges.

Antibacterial acrylic artificial hair fibers Antibacterial acrylic artificial hair fibers contain chitosan and a nonionic surfactant.

Chitosan is a product obtained by deacetylating chitin, which is a natural polymer. For example, chitosan can be obtained by deacetylating chitin, which is obtained from the exoskeleton of crustaceans such as crabs and prawns, through boiling in a concentrated alkali or the like. There is no particular limitation on the degree of deacetylation of chitosan, and the degree of deacetylation of chitosan is preferably about 60% to 99%, and for example, from the viewpoint of deodorization properties of the antibacterial acrylic artificial hair fibers, the degree of deacetylation of chitosan is preferably 70% to 99%, and more preferably 80% to 99%. The degree of deacetylation of chitosan can be measured, for example, through NMR spectroscopy, infrared absorption spectroscopy (IR), colloid titration, and the like. There is no particular limitation on the weight average molecular weight of chitosan, and the weight average molecular weight of chitosan may be about 10,000 to 1,000,000, and, from the viewpoint of handleability of an aqueous solution of chitosan, the weight average molecular weight of chitosan is preferably 10,000 to 500,000, and more preferably 10,000 to 300,000. In this specification, the weight average molecular weight of a compound can be measured through gel permeation chromatography (GPC), GPC measurement is performed using chloroform as a mobile phase and a polystyrene gel column, and the weight average molecular weight and the like can be determined in terms of polystyrene.

Because antibacterial acrylic artificial hair fibers are likely to come into contact with skin and mouth during use, from the viewpoint of safety, chitosan preferably contains only a small amount of allergens. Chitosan is often purified from raw materials derived from crustaceans, and thus may contain crustacean protein, which is one type of allergen. The content of crustacean protein in chitosan is, for example, preferably 9.9 μg or less, more preferably 5.0 μg or less, and 1.0 μg or less per gram of chitosan. For example, it may be determined that a sample containing 10 μg or more of protein derived from a specific raw material and the like per gram of sample food weight contains more than a trace amount of the specific raw material. The content of proteins in chitosan can be measured using, for example, ELISA. Specifically, the content of crustacean protein in chitosan can be measured through ELISA using Crustacean Kit II "Maruha Nichiro" manufactured by Maruha Nichiro Corporation or FA test EIA-Crutacean II "Nissui" manufactured by Nissui Pharmaceutical Co., Ltd.

The content of chitosan extracted with diluted acetic acid in the antibacterial acrylic artificial hair fibers is 0.005% by weight to 0.4% by weight. If the chitosan content is excessively low, the antibacterial properties will be poor. On the other hand, if the chitosan content is excessively high, it will be difficult to draw the antibacterial acrylic artificial hair fibers, resulting in poor process stability. From the viewpoint of antibacterial properties, the content of chitosan extracted with diluted acetic acid is preferably 0.01% by weight or more. From the viewpoint of favorable antibacterial properties and high deodorizing performance, the content of chitosan extracted with diluted acetic acid is preferably 0.02% by weight or more, more preferably 0.03% by weight or more, even more preferably 0.05% by weight or more, and particularly preferably 0.06% by weight or more. From the viewpoint of improving drawing properties and gloss, the content of chitosan extracted with diluted acetic acid is preferably 0.4% by weight or less, and more preferably 0.3% by weight or less. In this specification, the content of chitosan extracted with diluted acetic acid can be measured and calculated as follows.

Content of Chitosan Extracted with Diluted Acetic Acid 1) 1.87 g of glycine and 1.46 g of sodium chloride are dissolved in pure water to prepare a 250-g solution, and then, 0.1 M hydrochloric acid is added until the pH reaches 3.2 to produce a buffer solution.

2) 150 mg of Reactive Red 4 is dissolved in pure water to prepare a 100-g solution, and 5 g of the solution is diluted into 50 times the solution, with the buffer solution produced in 1), to produce a dye solution.

3) 3.0 g of fibers and 20 g of a 0.1% by weight acetic acid aqueous solution are introduced into a glass bottle, and heated at 90° C. for 1 hours to produce an extraction liquid.

4) The extraction liquid is cooled, and then 5 mL of the dye solution and 0.5 mL of the extraction liquid are mixed immediately, and the absorbance at 578 nm is measured using a UV visible spectrophotometer. At this time, a mixture of 0.5 mL of the buffer solution and 5 mL of the dye solution is used as a reference.

5) A calibration curve is created using the absorbance at 578 nm using a mixture of 5 mL of the dye solution and 0.5 mL of a chitosan aqueous solution prepared at 0.0025% by weight to 0.025% by weight using the mixture of the 0.5 mL of the buffer solution and 5 mL of the dye solution as the reference. The chitosan concentration in the extraction liquid is calculated based on the calibration curve and the absorbance value determined in 4), and the content of chitosan extracted with the diluted acetic acid is determined.

The content of chitosan in the antibacterial acrylic artificial hair fibers may be represented as the content of chitosan extracted with diluted acetic acid by extracting chitosan using diluted acetic acid as described above, or may be represented as the content of chitosan extracted with concentrated hydrochloric acid by extracting chitosan using concentrated hydrochloric acid as described above. Note that when chitosan is extracted with concentrated hydrochloric acid, most of the chitosan can be extracted from the fibers.

The content of chitosan extracted with concentrated hydrochloric acid in the antibacterial acrylic artificial hair fibers is 0.014% by weight to 1.2% by weight. If the chitosan content is excessively low, the antibacterial properties will be poor. On the other hand, if the chitosan content is excessively high, it will be difficult to draw the antibacterial acrylic artificial hair fibers, resulting in poor process stability. From the viewpoint of antibacterial properties, the content of chitosan extracted with concentrated hydrochloric acid is preferably 0.015% by weight or more, and more preferably 0.02% by weight or more. From the viewpoint of favorable antibacterial properties and high deodorizing performance, the content of chitosan extracted with concentrated hydrochloric acid is preferably 0.04% by weight or more, more preferably 0.06% by weight or more, even more preferably 0.08% by weight or more, and particularly preferably 0.1% by weight or more. From the viewpoint of improving drawing properties and gloss, the content of chitosan extracted with concentrated hydrochloric acid is preferably 1.0% by weight or less, more preferably 0.9% by weight or less, even more preferably 0.8% by weight or less, and further preferably 0.7% by weight or less. In this specification, the content of chitosan extracted with concentrated hydrochloric acid can be measured and calculated as follows.

Content of Chitosan Extracted with Concentrated Hydrochloric Acid

Chitosan is decomposed by heating 0.2 g of a fiber sample under reflux using 10 mL of 12N hydrochloric acid, the volume is adjusted with water to 20 mL, and thus a chitosan decomposition solution is obtained. To 30 mL of water, 2 mL of the chitosan decomposition solution and 3.8 g of sodium borate are added, the resulting mixture is neutralized with 12N hydrochloric acid to have a pH of 7, and the volume is adjusted to 50 mL. An HPLC test solution is prepared by mixing 1 mL of the obtained solution with the derivatization reagent 9-fluorenylmethyl chloroformate (20 mg/20 mL acetonitrile solution), leaving the mixture, and adding 3 mL of a mixed solvent of acetonitrile:water=1:1 (containing 0.25% formic acid). The content of chitosan extracted with concentrated hydrochloric acid is determined using the peak area obtained through HPLC analysis and the calibration curve created using glucosamine hydrochloride.

The nonionic surfactant is one or more selected from the group consisting of polyoxyethylene sorbitan fatty acid esters, polyoxyethylene fatty acid monoesters, and polyoxyethylene alkyl ethers. The nonionic surfactant has an HLB of 13.0 or more. In this specification, the HLB (hydrophilic-lipophilic balance) of the nonionic surfactant is determined using Griffin's method. When the nonionic surfactant has an HLB of 13.0 or more, aggregation of chitosan on the surfaces of the fibers can be easily suppressed, and the gloss of the fibers can be improved. The HLB of the nonionic surfactant is preferably 13.5 or more, more preferably 14.0 or more, even more preferably 14.5 or more, and particularly preferably 15.0 or more. Also, from the viewpoint of emulsifying properties, the HLB of the nonionic surfactant may be 19 or less.

There is no particular limitation on the polyoxyethylene sorbitan fatty acid esters as long as it has an HLB of 13.0 or more. For example, it is possible to use a sorbitan fatty acid monoester to which an oxyethylene group is added, as appropriate. The average number of moles of oxyethylene groups added is preferably 5 to 100 moles, and more preferably 10 to 50 moles. The number of carbon atoms in a fatty acid may be 4 to 30, is preferably 6 to 28, more preferably 8 to 26, even more preferably 10 to 24, and particularly preferably 12 to 22. A carbon chain of the fatty acid may be linear or branched. The fatty acid may be a saturated fatty acid or an unsaturated fatty acid.

Examples of the saturated fatty acid include lauric acid, palmitic acid, heptadecanoic acid, stearic acid, arachidic acid, behenic acid, tetracosanoic acid, hexacosanoic acid, and octacosanoic acid.

Examples of the unsaturated fatty acid include palmitoleic acid, oleic acid, vaccenic acid, nervonic acid, linoleic acid, eicosadienoic acid, linolenic acid, mead acid, and arachidonic acid.

From the viewpoint of further improving gloss, the polyoxyethylene sorbitan fatty acid ester is further preferably one or more selected from the group consisting of polyoxyethylene sorbitan monooleate and polyoxyethylene sorbitan monolaurate. The average number of moles of oxyethylene groups added in the polyoxyethylene sorbitan monooleate is preferably 10 to 100, and more preferably 15 to 30. The average number of moles of oxyethylene groups added in the polyoxyethylene sorbitan monolaurate is preferably 10 to 100, and more preferably 15 to 100.

There is no particular limitation on the polyoxyethylene fatty acid monoester as long as it has an HLB of 13.0 or more. For example, it is possible to use a monoester of a fatty acid and polyoxyethylene glycol, as appropriate. The average number of moles of oxyethylene groups added is preferably 5 to 100, and more preferably 10 to 50. The number of carbon atoms in a fatty acid may be 4 to 30, is preferably 6 to 28, more preferably 8 to 26, even more preferably 10 to 24, and particularly preferably 12 to 20. A carbon chain of the fatty acid may be linear or branched. The fatty acid may be a saturated fatty acid or an unsaturated fatty acid. Examples of saturated fatty acids and unsaturated fatty acids include the above-described fatty acids. Specifically, examples of the polyoxyethylene fatty acid monoesters include polyoxyethylene monolaurate, polyoxyethylene monocaprate, polyoxyethylene monopalmitate, polyoxyethylene monostearate, and polyoxyethylene monooleate. From the viewpoint of further improving gloss, polyoxyethylene monolaurate is preferable, and polyoxyethylene monolaurate having an average number of moles of added oxyethylene groups of 5 to 15 is more preferable.

There is no particular limitation on the polyoxyethylene alkyl ether as long as it has an HLB of 13.0 or more. The average number of moles of oxyethylene groups added is preferably 5 to 100, and more preferably 10 to 30. In the polyoxyethylene alkyl ether, the alkyl moiety may have 4 to 30 carbon atoms, preferably have 6 to 28 carbon atoms, and more preferably have 8 to 26 carbon atoms. A carbon chain of the alkyl moiety may be linear or branched. Specifically, examples of the polyoxyethylene alkyl ether include polyoxyethylene-(2-ethyl)hexyl ether, polyoxyethylene lauryl ether, polyoxyethylene palmityl ether, polyoxyethylene stearyl ether, and polyoxyethylene oleyl ether. From the viewpoint of further improving gloss, polyoxyethylene-(2-ethyl)hexyl ether is preferable, and polyoxyethylene-(2-ethyl)hexyl ether having an average number of moles of added oxyethylene groups of 5 to 20 is more preferable.

There is no particular limitation on the melting point of the nonionic surfactant in the antibacterial acrylic artificial hair fibers, and from the viewpoint of gloss, the melting point thereof is preferably 25° C. or less, more preferably 22° C. or less, even more preferably 20° C. or less, and particularly preferably 18° C. or less. In this specification, the melting point of the nonionic surfactant is determined using a visual observation method or the like.

The content of the nonionic surfactant in the antibacterial acrylic artificial hair fibers is 0.10% by weight to 0.90% by weight. When the content of the nonionic surfactant is less than 0.10% by weight, process stability and processability will decrease due to static electricity generation. When the content of the nonionic surfactant exceeds 0.90% by weight, separability of fiber bundles will deteriorate and processability will decrease. The content of the nonionic surfactant is preferably 0.80% by weight or less, more preferably 0.70% by weight or less, even more preferably 0.60% by weight or less, and particularly preferably 0.50% by weight or less. The content of nonionic surfactant (oil) (also referred to as the "oil adhesion amount of" hereinafter) can be measured as follows.

Oil Adhesion Amount

A sample (fibers) having a weight of about 2 g (sample weight W0) is cut to 12 to 15 cm, and is filled into a stainless steel tube (an oil extraction tube) whose lower end has a hole with a size of about 1 mm. Then, 35 mL of a mixture of ethanol and cyclohexane at a ratio of ethanol:cyclohexane=1:1 (weight ratio) is prepared as liquid for extracting an oil, and about 20 mL of the extraction liquid is introduced into the oil extraction tube. A lid of the oil extraction tube is adjusted such that the dropping rate of the extraction liquid is about 1 drop/1 to 1.5 seconds, and extraction of the oil is started. At this time, a tray (empty tray weight W1) heated to 120° C. using a heater is used as a tray for a dropping solution, and set such that the dropping solution will be dropped onto the tray. When dropping of the solution is completed, the lid is temporarily removed, and the fibers present in the oil extraction tube are pressed using a stainless steel rod to squeeze out the extraction liquid. This operation is performed again using the remaining extraction liquid (about 15 mL). After the extraction is completed, the tray is placed in an oven at 90° C., taken out in 5 minutes, the total tray weight (W2) of the tray where the extraction liquid has dried and evaporated and only the oil remains is measured, and the oil adhesion amount (% by weight) is calculated using Formula 1 below.

$$\text{Oil adhesion amount (\% by weight)} = (W2 - W1)/W0 \times 100 \quad \text{[Formula 1]}$$

There is no particular limitation on the acrylic copolymer that constitutes the antibacterial acrylic artificial hair fibers, and it is possible to use, for example, an acrylic copolymer containing acrylonitrile in an amount of less than 95% by weight and other monomers in an amount of more than 5% by weight, and preferably it is possible to use an acrylic copolymer containing acrylonitrile in an amount of less than 80% by weight and other monomers in an amount of more than 20% by weight. Specifically, the acrylic copolymer preferably contains acrylonitrile in an amount of 29.5% by weight to 79.5% by weight, vinyl chloride and/or vinylidene chloride in an amount of 20% by weight to 70% by weight, and a sulfonic acid group-containing vinyl monomer in an amount of 0.5% by weight to 5% by weight. When the content of acrylonitrile in the acrylic copolymer is 29.5% by weight to 79.5% by weight, the antibacterial acrylic artificial hair fibers have favorable heat resistance. When the acrylic copolymer contains vinyl chloride and/or vinylidene chloride in an amount of 20% by weight to 70% by weight, the antibacterial acrylic artificial hair fibers have favorable flame retardance. When the acrylic copolymer contains a sulfonic acid group-containing vinyl monomer in an amount of 0.5% by weight to 5% by weight, hydrophilicity increases. The acrylic copolymer further preferably contains acrylonitrile in an amount of 34.5% by weight to 74.5% by weight, vinyl chloride and/or vinylidene chloride in an amount of 25% by weight to 65% by weight, and a sulfonic acid group-containing vinyl monomer in an amount of 0.5% by weight to 5% by weight, even more preferably contains acrylonitrile in an amount of 39.5% by weight to 74.5% by weight, vinyl chloride in an amount of 25% by weight to 60% by weight, and a sulfonic acid group-containing vinyl monomer in an amount of 0.5% by weight to 5% by weight, further more preferably contains acrylonitrile in an amount of 39.5% by weight to 69.5% by weight, vinyl chloride in an amount of 30% by weight to 60% by weight, and a sulfonic acid group-containing vinyl monomer in an amount of 0.5% by weight to 5% by weight, still more preferably contains acrylonitrile in an amount of 39.5% by weight to 59.5% by weight, vinyl chloride in an amount of 40% by weight to 60% by weight, and a sulfonic acid group-containing vinyl monomer in an amount of 0.5% by weight to 5% by weight, and particularly preferably contains acrylonitrile in an amount of 39.5% by weight to 49.5% by weight, vinyl chloride in an amount of 50% by weight to 60% by weight, and a sulfonic acid group-containing vinyl monomer in an amount of 0.5% by weight to 5% by weight. From the viewpoint of a good feel, the acrylic copolymer preferably contains vinyl chloride.

There is no particular limitation on the sulfonic acid group-containing vinyl monomer, and it is possible to use, as a sulfonic acid group-containing vinyl monomer, for example, allyl sulfonic acid, methallyl sulfonic acid, styrenesulfonic acid, isoprene sulfonic acid, 2-acrylamido-2-methylpropanesulfonic acid, and metal salts such as sodium salts thereof, and amine salts thereof, and the like. The sulfonic acid group-containing vinyl monomers may be used alone or in combination of two or more.

In one or more embodiments of the present invention, antibacterial acrylic artificial hair fibers may contain another additive agent for improving fiber properties as needed as long as it does not impede effects of the present invention. Examples of the additive agent include gloss modifiers, coloring agents such as organic pigments, inorganic pigments, and dyes, light stabilizers, heat stabilizers, fiber sizing agents, deodorants, and fragrances. From the viewpoint of gloss and the stability of the chitosan-containing oil, the antibacterial acrylic artificial hair fibers preferably contain, as an oil, only one or more nonionic surfactants selected from the group consisting of polyoxyethylene sorbitan fatty acid esters, polyoxyethylene fatty acid monoesters, and polyoxyethylene alkyl ethers. Note that when the antibacterial acrylic artificial hair fibers contain another oil, from the viewpoint of separability of fiber bundles, the total content of other oils, and one or more nonionic surfactants having an HLB of 13.0 or more and selected from the group consisting of polyoxyethylene sorbitan fatty acid esters, polyoxyethylene fatty acid monoesters, and polyoxyethylene alkyl ethers is preferably 0.90% by weight or less.

From the viewpoint of suitably using antibacterial acrylic artificial hair fibers as artificial hair, the antibacterial acrylic artificial hair fibers preferably have a single fiber fineness of 10 to 100 dtex, more preferably have a single fiber fineness of 20 to 95 dtex, even more preferably have a single fiber fineness of 25 to 85 dtex, further preferably have a single fiber fineness of 30 to 75 dtex, and particularly preferably have a single fiber fineness of 35 to 65 dtex.

From the viewpoint of favorable antibacterial properties, the antibacterial acrylic artificial hair fibers preferably have an antibacterial activity value of 2.2 or more, more preferably have an antibacterial activity value of 3.0 or more, and even more preferably have an antibacterial activity value of 4.0 or more, the antibacterial activity value being measured in accordance with Japanese Industrial Standards (JIS) L 1902:2015. From the viewpoint of favorable antibacterial properties even after washing, the antibacterial acrylic artificial hair fibers preferably have an antibacterial activity value of 4.0 or more, and more preferably have an antibacterial activity value of 4.5 or more, the antibacterial activity value being measured in accordance with JIS L 1902:2015. The antibacterial acrylic artificial hair fibers have powerful antibacterial properties against bacteria such as *Staphylococcus aureus*, for example.

From the viewpoint of high odor resistance, as for the antibacterial acrylic artificial hair fibers, the volatilization amount of isovaleric acid generated through the growth of bacteria such as *Staphylococcus aureus* is preferably 150 g or less, more preferably 100 μg or less, and even more preferably 70 μg or less, per kilogram of the antibacterial acrylic artificial hair fibers. Isovaleric acid is known as an odor component generated from the scalp. In this specification, the volatilization amount of isovaleric acid generated through the growth of bacteria can be specifically measured as described in Examples.

When the antibacterial acrylic artificial hair fibers are black, from the viewpoint of good gloss, a gloss $L_{BNT}$ as defined by Bossa Nova Technologies is preferably 50.0 or more, and more preferably 65.0 or more. $L_{BNT}$ is calculated using Formula 2 below by emitting light from a light source to a fiber bundle attached to a curved surface and measuring the intensity of specularly reflected light and diffusely reflected light, using the SAMBA Hair System manufactured by Bossa Nova Technologies.

$$L_{BNT} = 100 \times \{S_{in} / (D + S_{out})\} \times (1 / W_{visual}) \quad \text{[Formula 2]}$$

$S_{in}$: Center specularly reflected light intensity $S_{out}$: Off-center specularly reflected light intensity D: Diffusely reflected light intensity $W_{visual}$ [degree]: Width of reflected light The antibacterial acrylic artificial hair fibers have powerful deodorization properties, and for example, the percentage for deodorizing isovaleric acid is preferably 60% or more, more preferably 70% or more, even more preferably 80% or more, and particularly preferably 90% or more. Isovaleric acid is known as an odor component generated from the scalp. In this specification, the deodorization properties can be measured using the following method.

Deodorization Properties

1) An aqueous solution containing 0.03% isovaleric acid was prepared.

2) To the surface of 1 g of the sample, 0.2 mL of the isovaleric acid aqueous solution was applied, the sample was placed in the 1-L sampling bag, and a cut portion was closed.

3) The inside of the bag was degassed using a vacuum pump, 0.5 L of high-purity nitrogen gas was injected through an integrating flowmeter, and the bag was sealed.

4) The bag was left at room temperature (20±5° C.) for 2 hours, a volatile organic compound contained in 0.1 L of nitrogen gas in the bag was collected using a cartridge containing 2,6-diphenyl-p-phenylene oxide, and analysis was conducted using a gas chromatograph mass spectrometer. The area of the peak corresponding to isovaleric acid in a total ion chromatogram was determined using analysis software, and the gas concentration was determined using a calibration curve created in advance.

5) The gas concentration was determined in the same manner using a control instead of the sample. AFRELLE (modacrylic fibers, manufactured by Kaneka Corporation, hereinafter, also simply referred to as "AFRELLE"), which is a hair ornament product, was used as the control.

6) The deodorization percentage was determined based on the measured gas concentration using Formula 3 below.

[Formula 3]

$$\text{Deodorization percentage}[\%] = \{1 - (\text{sample gas concentration [ppm]}) / (\text{control gas concentration [ppm]})\} \times 100$$

Production Method

Antibacterial acrylic artificial hair can be produced by, for example, wet-spinning a spinning solution containing an acrylic copolymer, and applying chitosan and one or more nonionic surfactants having an HLB of 13.0 or more and selected from the group consisting of polyoxyethylene sorbitan fatty acid esters, polyoxyethylene fatty acid monoesters, and polyoxyethylene alkyl ethers to resulting filaments before the filaments are dried.

The spinning solution can be obtained by, for example, dissolving an acrylic copolymer in an organic solvent. There is no particular limitation on the organic solvent, and it is possible to use a good solvent for an acrylic copolymer as appropriate. Examples of the good solvent include dimethyl sulfoxide (DMSO), dimethylacetamide (DMAc), N,N-dimethylformamide (DMF), and acetone. From the viewpoint of versatility, acetone may be used. From the viewpoint of high safety, dimethyl sulfoxide may be used. The spinning solution may contain a small amount of water, for example, may contain water in an amount of 1.5% by weight to 4.8% by weight. Accordingly, it is possible to suppress formation of voids.

The spinning solution preferably contains an epoxy group-containing compound in an amount of 0.1 parts by weight or more, more preferably 0.2 parts by weight or more, and even more preferably 0.3 parts by weight or more, with respect to 100 parts by weight of the acrylic copolymer. An epoxy group-containing compound is preferably added to the spinning solution because the epoxy group-containing compound can suppress odor, coloring of the fibers due to heat, devitrification of the fibers due to hot water, and the like. In particular, when dimethyl sulfoxide is used as an organic solvent, it is possible to effectively suppress the generation of malodorous components formed through decomposition of dimethyl sulfoxide when acrylic artificial hair fibers are heated. Also, from the viewpoint of spinnability, fiber quality, and cost, the spinning solution preferably contains an epoxy group-containing compound in an amount of 5 parts by weight or less, more preferably 3 parts by weight or less, and even more preferably 1 part by weight or less, with respect to 100 parts by weight of the acrylic copolymer.

It is possible to use, as the epoxy group-containing compound, for example, glycidyl methacrylate-containing polymers, glycidyl acrylate-containing polymers, epoxidized vegetable oils, glycidyl ether type epoxy resins, glycidyl amine type epoxy resins, glycidyl ester type epoxy resins, and cycloaliphatic epoxy resins. The epoxy group-containing compounds may be used alone or in combination of two or more.

From the viewpoint of epoxy equivalent (the weight of resin containing 1 equivalent of epoxy groups), inhibition of fiber coloration, solubility of the epoxy group-containing compound in dimethyl sulfoxide, and reduction in elution thereof into a spinning bath, the epoxy group-containing compound is preferably a glycidyl methacrylate-containing polymer and/or a glycidyl acrylate-containing polymer, and more preferably polyglycidyl methacrylate.

There is no particular limitation on the weight average molecular weight of the epoxy group-containing compound, and for example, the weight average molecular weight of the epoxy group-containing compound may be determined as appropriate, in consideration of solubility in dimethyl sulfoxide and elution into the spinning bath. When the epoxy group-containing compound is a glycidyl methacrylate-containing polymer and/or a glycidyl acrylate-containing polymer, the weight average molecular weight is preferably 3,000 or more, for example, from the viewpoint of reducing elution into the spinning bath, and the weight average molecular weight is preferably 100,000 or less from the viewpoint of solubility of the epoxy group-containing compound into an organic solvent such as dimethyl sulfoxide.

The spinning solution may contain another additive agent for improving fiber properties as needed as long as it does not impede effects of the present invention. Examples of the additive agent include gloss modifiers, coloring agents such as organic pigments, inorganic pigments, and dyes, and stabilizers for improving light resistance and heat resistance.

The wet-spinning may include at least a coagulation process, a water washing process, and a drying process. The wet-spinning preferably includes a wet-drawing process performed before the water washing process or after the water washing process and before the drying process. From the viewpoint of the durability of chitosan, chitosan and the nonionic surfactants need to be applied (hereinafter, also referred to as an "oil application process") before the drying process. The amount of chitosan applied is preferably about 3 times the desired amount of chitosan extracted with diluted acetic acid in the obtained acrylic fibers, or is preferably about 1 times the desired amount of chitosan extracted with concentrated hydrochloric acid in the obtained acrylic fibers. The oil application process is preferably performed after the wet-drawing process. Also, from the viewpoint of fiber strength, it is preferable that the production method includes a dry-drawing process, which is performed after the drying process. Further, if necessary, the production method may include a thermal relaxation treatment, which is performed after the dry drawing process.

First, in the coagulation process, filaments (also referred to as coagulated filaments) are formed by discharging the spinning solution into the coagulation bath through a spinning nozzle and coagulating the spinning solution. The spinning nozzle can be used as appropriate depending on a desired fiber cross section. There is no particular limitation on the fiber cross section, and the fiber cross section may be any cross section such as a circular, elliptical, or irregular shaped cross section.

There is no particular limitation on the spinning speed, and, for example, from the viewpoint of industrial productivity, the spinning speed is preferably 2 to 17 m/min. There is no particular limitation on the nozzle draft, and, for example, from the viewpoint of production process stability, the nozzle draft is preferably 0.8 to 2.0.

It is possible to use, for example, an aqueous solution in which a good solvent such as dimethyl sulfoxide has a concentration of 20% by weight to 70% by weight, as the coagulation bath. The temperature of the coagulation bath can be set to 5° C. to 40° C. If the concentration of the organic solvent in the coagulation bath is excessively low, it is likely that coagulation will progress fast, the coagulation structure will become coarse, and voids will form inside the fibers.

Then, in the wet-drawing process, the acrylic fibers (coagulated filaments) are preferably wet-drawn (also referred to as primary drawing) in a drawing bath. It is possible to use, as the drawing bath, an aqueous solution in which a good solvent such as dimethyl sulfoxide has a lower concentration than that in the coagulation bath. The temperature of the drawing bath is preferably 30° C. or more, more preferably 40° C. or more, and even more preferably 50° C. or more. There is no particular limitation on a draw ratio, and the draw ratio is preferably 2 to 8 times, from the viewpoint of increasing the strength and productivity of fibers. Note that when primary drawing is performed using a water bath, a bath-drawing process may be performed after a water washing process, which will be described later, or primary drawing and water washing may be performed simultaneously.

Then, in the water washing process, a good solvent such as dimethyl sulfoxide is removed from the acrylic fibers by washing the acrylic fibers with warm water at 30° C. or more. Alternatively, the coagulated filaments may be introduced into warm water at 30° C. or more, and primary drawing and water washing may be performed simultaneously. Alternatively, primary drawing may be performed after the water washing process is performed. A good solvent such as dimethyl sulfoxide can be easily removed from the acrylic fibers by, for example, using warm water at 70° C. or more in the water washing process.

Then, in the oil application process, chitosan and the nonionic surfactants (one or more nonionic surfactants having an HLB of 13.0 or more and selected from the group consisting of polyoxyethylene sorbitan fatty acid esters, polyoxyethylene fatty acid monoesters, and polyoxyethylene alkyl ethers) are applied to filaments using a chitosan-containing oil composition in which chitosan and the nonionic surfactants are dissolved in water or dispersed therein. In the oil application process, in order to improve a curl setting property using hot water, organic solvents such as dimethyl sulfone, ¿-caprolactam, ethylene carbonate, and sulfolane may be applied to the filaments.

The chitosan-containing oil composition may contain, for example, chitosan in an amount of 0.05% by weight to 5% by weight, and a nonionic surfactant in an amount of 0.5% by weight to 10% by weight. It is desired that the chitosan-containing oil composition contains acetic acid, hydrochloric acid, or the like in order to dissolve chitosan. There is no particular limitation on the chitosan-containing oil composition, and the chitosan-containing oil composition may contain, for example, chitosan in an amount of 0.05% by weight to 5% by weight, acetic acid in an amount of 0.025% by weight to 10% by weight, a nonionic surfactant in an amount of 0.5% by weight to 10% by weight, and dimethyl sulfone in an amount of 0.1% by weight to 5% by weight, and the remainder may be water.

The chitosan-containing oil composition may contain another additive agent for improving fiber properties as needed as long as it does not impede effects of the present invention. Examples of the additive agent include fiber sizing agents such as urethane-based polymers and cationic ester polymers.

Then, the acrylic fibers are dried in the drying process. There is no particular limitation on the drying temperature, and the drying temperature is, for example, 110° C. to 190° C. It is preferable that the dried fibers are further subjected to dry-drawing (secondary drawing). There is no particular limitation on the drawing temperature for secondary drawing, and the drawing temperature is, for example, 110° C. to 190° C. There is no particular limitation on the draw ratio, and for example, the draw ratio is preferably 1 to 4 times, more preferably 1 to 3 times, and further preferably 1 or 2 times. The total draw ratio including bath-drawing before drying is performed is preferably 2 to 10 times, more preferably 2 to 8 times, even more preferably 2 to 6 times, and particularly preferably 2 to 4 times.

After dry-drawing is performed, the fibers are preferably relaxed in a thermal relaxation treatment process. There is no particular limitation on a relaxation percentage, and, for example, the relaxation percentage is preferably 5% or more, and more preferably 10% to 30%. The thermal relaxation treatment can be performed at a high temperature, for example, in a dry heat atmosphere at 150° C. to 200° C. or in a superheated steam atmosphere.

Hair Ornament Products

There is no particular limitation on hair ornament products, and examples thereof include hair wigs, hairpieces, weaving hair, hair extensions, braided hair, hair accessories, and doll hair. The antibacterial acrylic artificial hair fibers may be used alone as artificial hair to form a hair ornament product. Alternatively, in addition to the antibacterial acrylic artificial hair fibers, other artificial hair fibers and natural fibers such as human hair and animal hair may be used in combination to form a hair ornament product. There is no particular limitation on the other artificial hair fibers, and examples thereof include polyvinyl chloride-based fibers, nylon fibers, polyester fibers, and regenerated collagen fibers.

EXAMPLES

Hereinafter, the present invention will be described with reference to examples of one or more embodiments of the present invention, but the present invention is not limited to examples below.

A measurement method and an evaluation method used in examples and comparative examples are as follows.

Single Fiber Fineness

Using an auto-vibronic fineness measuring device "DENIER COMPUTER Type DC-11" (manufactured by Search Co., Ltd.), the fineness of 30 samples was measured to determine their respective single fiber fineness, and the average of the measured values of the samples was calculated and taken as the single fiber fineness of the fibers.

Content of Chitosan Extracted with Diluted Acetic Acid

Using the following procedure, chitosan was extracted from the fibers using diluted acetic acid and the content of chitosan extracted with diluted acetic acid was determined.

1) 1.87 g of glycine (Fujifilm Wako Pure Chemical Corporation) and 1.46 g of sodium chloride (Fujifilm Wako Pure Chemical Corporation) were dissolved in pure water to prepare a 250-g solution, and then, 0.1 M hydrochloric acid (Fujifilm Wako Pure Chemical Corporation) was added until the pH reached 3.2 to produce a buffer solution.

2) 150 mg of Reactive Red 4 (MP Biomedicals, LLC) was dissolved in pure water to prepare a 100-g solution, and 5 g of the solution was diluted into 50 times the solution with the buffer solution produced in 1), to produce a dye solution.

3) 3.0 g of the fibers and 20 g of a 0.1% by weight acetic acid aqueous solution were introduced into a glass bottle, and heated at 90° C. for 1 hour to produce an extraction liquid.

4) The extraction liquid was cooled, and then 5 mL of the dye solution and 0.5 mL of the extraction liquid were mixed immediately, and the absorbance at 578 nm was measured using a UV visible spectrophotometer (UV-1800, Shimadzu Corporation). At this time, a mixture of 0.5 mL of the buffer solution and 5 mL of the dye solution was used as a reference.

5) A calibration curve was created using the absorbance at 578 nm using a mixture of 5 mL of the dye solution and 0.5 mL of a chitosan aqueous solution prepared at 0.0025% by weight to 0.025% by weight using the mixture of 0.5 mL of the buffer solution and 5 mL of the dye solution as the reference. The chitosan concentration in the extraction liquid was calculated based on the calibration curve and the absorbance value determined in 4), and the content of chitosan extracted with the diluted acetic acid was determined.

Content of Chitosan Extracted with Concentrated Hydrochloric Acid

Using the following procedure, chitosan was extracted from the fibers using concentrated hydrochloric acid and the content of chitosan extracted with concentrated hydrochloric acid was determined.

1) Chitosan was decomposed by heating 0.2 g of a pulverized fiber sample under reflux using 10 mL of 12N hydrochloric acid, the volume was adjusted with water to 20 mL, and thus a chitosan decomposition solution was obtained.

2) To 30 mL of water, 2 mL of the chitosan decomposition solution and 3.8 g of sodium borate were added, the resulting mixture was neutralized with 12N hydrochloric acid to have a pH of 7, and the volume was adjusted to 50 mL.

3) An HPLC test solution was prepared by mixing 1 mL of the solution obtained in 2) with the derivatization reagent 9-fluorenylmethyl chloroformate (20 mg/20 mL acetonitrile solution), leaving the mixture for 24 hours, and adding 3 mL of a mixed solvent of acetonitrile:water=1:1 (containing 0.25% formic acid).

4) The content of chitosan extracted with concentrated hydrochloric acid was determined using the peak area obtained through HPLC analysis and the calibration curve created using glucosamine hydrochloride.

Oil Adhesion Amount

A sample (fibers) having a weight of about 2 g (sample weight W0) was cut to 12 to 15 cm, and was filled into a stainless steel tube (an oil extraction tube) whose lower end had a hole with a size of about 1 mm. Then, 35 mL of a mixture of ethanol and cyclohexane at a ratio of ethanol: cyclohexane=1:1 (weight ratio) was prepared as a liquid for extracting an oil, and about 20 mL of the extraction liquid was introduced into the oil extraction tube. A lid of the oil extraction tube was adjusted such that the dropping rate of the extraction liquid was about 1 drop/1 to 1.5 seconds, and extraction of the oil was started. At this time, a tray (empty tray weight W1) heated to 120° C. using a heater was used as a tray for a dropping solution, and set such that the dropping solution would be dropped onto the tray. When dropping of the solution was completed, the lid was temporarily removed, and the fibers present in the oil extraction tube were pressed using a stainless steel rod to squeeze out the extraction liquid. This operation was performed again using the remaining extraction liquid (about 15 mL). After the extraction was completed, the tray was placed in an oven at 90° C., taken out in 5 minutes, the total tray weight (W2) of the tray where the extraction liquid had dried and evaporated and only the oil remained was measured, and the oil adhesion amount (% by weight) was calculated using Formula 1 below.

$$\text{Oil adhesion amount (\% by weight)} = (W2 - W1)/W0 \times 100 \quad \text{[Formula 1]}$$

Antibacterial Properties

The antibacterial activity value was measured by JIS L 1902:2015 Textiles—Determination of antibacterial activity and efficacy of textile products (Absorption method). *Staphylococcus aureus* was used in testing. In order to prevent the shape of a sample from deteriorating, testing was conducted without performing high-pressure steam sterilization on the sample. According to the "Certification Standard of SEK Mark Textile Products," when a sample has an antibacterial activity value of 2.2 or more, the sample has antibacterial and odor resistance effects.

Odor Resistance

The volatilization amount of isovaleric acid generated through the growth of bacteria was measured using the following procedure.

1) A test bacterial solution was prepared by mixing 10 mL of 2×YT medium, 5.0 mL of 2% L-leucine, 4.8 mL of sterile water, and 0.2 mL of a microorganism suspension (*Staphylococcus aureus*, turbidity OD600=1.0).

2) A fiber sample was cut to a length of about 3 cm, 0.4 g of the sample was introduced into a 50-mL vial, 100 μL of the test bacterial solution was added, and the sample was left at 37° C. for 72 hours, to culture the microorganisms. 3) The entire amount of each sample was taken out from the vial containing the sample cultured for 72 hours, the samples are collectively placed in a 5-L sampling bag, and the cut portion was closed. The inside of the bag was degassed using a vacuum pump, 2 L of high-purity nitrogen gas was injected, and the bag was sealed.

4) The bag was left at room temperature for 2 hours, a volatile organic compound contained in 1 L of nitrogen gas in the bag was collected using a cartridge containing 2,6-diphenyl-p-phenylene oxide, and analysis was conducted using a gas chromatograph mass spectrometer. The area of the peak corresponding to isovaleric acid in a total ion chromatogram was determined using attached analysis software, and the volatilization amount was determined using a calibration curve created in advance.

5) When the operation 4 was completed, the sample was taken out from the bag and dried at 120° C., and the dry mass of the sample was obtained.

6) The volatilization amount of isovaleric acid per kilogram of the dry mass of the fibers was calculated using the volatilization amount of isovaleric acid obtained in the operation 4 and the dry mass of the sample obtained in the operation 5. The lower limit of quantitative measurement was 42 μg/kg.

Gloss

Evaluation 1

Sensory evaluation was performed by three persons who had been engaged in the beauty evaluation of hairpieces for three years or more, using a fiber bundle sample with a total fineness of 1.2 million to 1.3 million dtex, and gloss was evaluated. AFRELLE was used as a reference sample. $L_{BNT}$ measured and calculated in Evaluation 2 of the gloss of reference sample was 56.3.

A (very good): sample was evaluated to have better gloss than reference sample

B (good): sample was evaluated to have gloss equivalent to that of reference sample C (poor): sample was evaluated to have worse gloss than reference sample Evaluation 2

$L_{BNT}$ was measured and calculated using the SAMBA Hair System manufactured by Bossa Nova Technologies, and gloss was evaluated based on the $L_{BNT}$ in the following three stages.

$L_{BNT}$ $L_{BNT}$ was calculated using Formula 2 below by emitting light from a light source to a fiber bundle attached to a curved surface and measuring the intensity of specularly reflected light and diffusely reflected light, using the SAMBA Hair System manufactured by Bossa Nova Technologies.

$$L_{BNT} = 100 \times \{S_{in} / (D + S_{out})\} \times (1 / W_{visual}) \quad \text{[Formula 2]}$$

$S_{in}$: Center specularly reflected light intensity $S_{out}$: Off-center specularly reflected light intensity D: Diffusely reflected light intensity $W_{visual}$ [degree]: Width of reflected light Evaluation A (very good): $L_{BNT} \geq 65.0$ B (good): $50.0 \leq L_{BNT} < 65.0$ C (poor): $L_{BNT} < 50.0$ Example 1

A resin solution having an acrylic copolymer concentration of 26.0% by weight and a water concentration of 2.7% by weight was produced by dissolving, in dimethyl sulfoxide (DMSO), an acrylic copolymer containing acrylonitrile in an amount of 46% by weight, vinyl chloride in an amount of 52% by weight, and sodium styrene sulfonate in an amount of 2% by weight. Then, carbon black, red dye (C.I Basic Red 46), and blue dye (C.I Basic Blue 41) were added as colorants to the resin solution, such that the amount of carbon black was 2.1 parts by weight, the amount of red dye was 0.04 parts by weight, and the amount of blue dye was 0.07 parts by weight with respect to 100 parts by weight of the acrylic copolymer. Furthermore, polyglycidyl methacrylate (weight average molecular weight was 12,000) was added to this solution in an amount of 0.8 parts by weight with respect to 100 parts by weight of the acrylic copolymer to produce a spinning solution. The obtained spinning solution was subjected to wet-spinning by extruding the spinning solution at a spinning speed of 2 m/min in a coagulation bath including an aqueous solution of DMSO having a temperature of 25° C. and a concentration of 47% by weight, using a spinning nozzle (having a hole size of 0.3 mm and a hole count of 100), and then drawn to 2.1 times their original length in a drawing bath including an aqueous solution of DMSO having a temperature of 90° C. and a concentration of 50% by weight. Then, water washing was performed using warm water having a temperature of 90° C. Subsequently, the primary drawn filaments, which had been washed with water, were impregnated with a chitosan-containing oil composition (containing chitosan in an amount of 0.1% by weight, acetic acid in an amount of 0.05% by weight, polyoxyethylene (20) sorbitan monostearate (a numerical value in parentheses indicates the average number of moles of oxyethylene groups added, and the same applies to the following; HLB: 15.0, the melting point: −25° C.) in an amount of 5.0% by weight, dimethyl sulfone in an amount of 2.0% by weight, and distilled water in an amount of 92.9% by weight) by immersing the filaments in an oil bath (60° C.) containing the chitosan-containing oil composition for 1 to 3 seconds, and then the filaments were dried at 140° C., drawn to 3 times their original length, and subjected to 27% relaxation treatment at 155° C. to obtain acrylic fibers having a single fiber fineness of about 46 dtex. Chitosan had a degree of deacetylation of 71%. The content of crustacean protein in chitosan was measured using Crustacean Kit II "Maruha Nichiro" manufactured by Maruha Nichiro Corporation and FA test EIA-Crutacean II "Nissui" manufactured by Nissui Pharmaceutical Co., Ltd., revealing that the content of crustacean protein in chitosan was 0.1 μg or less per gram of chitosan (the lower limit of quantitative measurement or less).

Example 2

Acrylic fibers having a single fiber fineness of about 46 dtex were obtained in the same manner as in Example 1, except that a composition, which contained chitosan in an amount of 1.0% by weight, acetic acid in an amount of 0.5% by weight, polyoxyethylene (20) sorbitan monooleate (HLB: 15.0, the melting point: −25° C.) in an amount of 4.4% by weight, dimethyl sulfone in an amount of 2.0% by weight, and distilled water in an amount of 92.1% by weight, was used as a chitosan-containing oil composition.

Example 3

Acrylic fibers having a single fiber fineness of about 46 dtex were obtained in the same manner as in Example 1, except that a composition, which contained chitosan in an amount of 3.0% by weight, acetic acid in an amount of 1.5% by weight, polyoxyethylene (20) sorbitan monooleate (HLB: 15.0, the melting point: −25° C.) in an amount of 4.4% by weight, dimethyl sulfone in an amount of 2.0% by weight, and distilled water in an amount of 89.1% by weight, was used as a chitosan-containing oil composition.

Example 4

Acrylic fibers having a single fiber fineness of about 46 dtex were obtained in the same manner as in Example 1, except that a composition, which contained chitosan in an amount of 1.0% by weight, acetic acid in an amount of 0.5% by weight, polyoxyethylene (20) sorbitan monooleate (HLB: 15.0, the melting point: −25° C.) in an amount of 3.0% by weight, dimethyl sulfone in an amount of 2.0% by weight, and distilled water in an amount of 93.5% by weight, was used as a chitosan-containing oil composition.

Example 5

Acrylic fibers having a single fiber fineness of about 46 dtex were obtained in the same manner as in Example 1, except that a composition, which contained chitosan in an amount of 1.0% by weight, acetic acid in an amount of 0.5% by weight, polyoxyethylene (20) sorbitan monooleate (HLB: 15.0, the melting point: −25° C.) in an amount of 7.0% by weight, dimethyl sulfone in an amount of 2.0% by weight, and distilled water in an amount of 89.5% by weight, was used as a chitosan-containing oil composition.

Example 6

Acrylic fibers having a single fiber fineness of about 46 dtex were obtained in the same manner as in Example 1, except that a composition, which contained chitosan in an amount of 1.0% by weight, acetic acid in an amount of 0.5% by weight, polyoxyethylene monolaurate (the average number of moles of oxyethylene groups added: 9, HLB: 13.3, the melting point: 10° C.) in an amount of 6.0% by weight, dimethyl sulfone in an amount of 2.0% by weight, and distilled water in an amount of 90.5% by weight, was used as a chitosan-containing oil composition.

Example 7

Acrylic fibers having a single fiber fineness of about 46 dtex were obtained in the same manner as in Example 1, except that a composition, which contained chitosan in an amount of 1.0% by weight, acetic acid in an amount of 0.5% by weight, polyoxyethylene-(2-ethyl)hexyl ether (the average number of moles of oxyethylene groups added: 9, HLB: 15, the melting point: −25° C.) in an amount of 6.0% by weight, dimethyl sulfone in an amount of 2.0% by weight, and distilled water in an amount of 90.5% by weight, was used as a chitosan-containing oil composition.

Example 8

Acrylic fibers having a single fiber fineness of about 46 dtex were obtained in the same manner as in Example 1, except that a composition, which contained chitosan in an amount of 1.0% by weight, acetic acid in an amount of 0.5% by weight, polyoxyethylene (20) sorbitan monolaurate (HLB: 16.7, the melting point: −14° C.) in an amount of 6.0% by weight, dimethyl sulfone in an amount of 2.0% by weight, and distilled water in an amount of 90.5% by weight, was used as a chitosan-containing oil composition.

Comparative Example 1

Filaments were impregnated with a chitosan-containing oil composition in the same manner as in Example 1 and dried at 140° C., except that a composition, which contained chitosan in an amount of 5.0% by weight, acetic acid in an amount of 2.5% by weight, polyoxyethylene (20) sorbitan monooleate (HLB: 15.0, the melting point: −25° C.) in an amount of 4.4% by weight, dimethyl sulfone in an amount of 2.0% by weight, and distilled water in an amount of 86.1% by weight, was used as the chitosan-containing oil composition. Then, attempts were made to perform drawing, but drawing failed.

Comparative Example 2

Acrylic fibers having a single fiber fineness of about 46 dtex were produced in the same manner as in Example 1, except that a composition, which contained chitosan in an amount of 1.0% by weight, acetic acid in an amount of 0.5% by weight, polyoxyethylene (20) sorbitan monooleate (HLB: 15.0, the melting point: −25° C.) in an amount of 0.4% by weight, dimethyl sulfone in an amount of 2.0% by weight, and distilled water in an amount of 96.1% by weight, was used as a chitosan-containing oil composition, but the acrylic fibers had strong static electricity and were difficult to handle.

Comparative Example 3

When acrylic fibers having a single fiber fineness of about 46 dtex were produced in the same manner as in Example 1, except that a composition, which contained chitosan in an amount of 1.0% by weight, acetic acid in an amount of 0.5% by weight, polyoxyethylene (20) sorbitan monooleate (HLB: 15.0, the melting point: −25° C.) in an amount of 10% by weight, dimethyl sulfone in an amount of 2.0% by weight, and distilled water in an amount of 86.5% by weight, was used as a chitosan-containing oil composition, separability of fiber bundles deteriorated.

Comparative Example 4

Acrylic fibers having a single fiber fineness of about 46 dtex were obtained in the same manner as in Example 1, except that a composition, which contained chitosan in an amount of 1.0% by weight, acetic acid in an amount of 0.5% by weight, polyoxyethylene (20) sorbitan trioleate (HLB: 11.0, the melting point: −20° C.) in an amount of 6.0% by weight, dimethyl sulfone in an amount of 2.0% by weight, and distilled water in an amount of 90.5% by weight, was used as a chitosan-containing oil composition.

The chitosan content, oil adhesion amount, antibacterial properties, odor resistance, and gloss of the acrylic fibers of Examples and Comparative Examples were measured and evaluated as described above, and the results are shown in Table 1 below.

TABLE 1

| | Content of chitosan extracted with diluted acetic acid (% by weight) | Content of chitosan extracted with concentrated hydrochloric acid (% by weight) | Oil adhesion amount (% by weight) | Antibacterial activity value | Odor resistance Isovaleric acid volatilization amount (μg/kg) | Gloss Evaluation 1 | Gloss Evaluation 2 $L_{BNT}$ | Gloss Evaluation 2 Evaluation |
|---|---|---|---|---|---|---|---|---|
| Ex. 1 | 0.005 | 0.014 | 0.7 | 5.7 | 4800 | A | 79.57 | A |
| Ex. 2 | 0.1 | 0.23 | 0.2 | 6.2 | 42 or less | B | 64.59 | B |
| Ex. 3 | 0.3 | 0.70 | 0.2 | 4.3 | 42 or less | B | 78.06 | A |
| Ex. 4 | 0.1 | 0.26 | 0.1 | 6.2 | 42 or less | B | 66.97 | A |
| Ex. 5 | 0.1 | 0.22 | 0.5 | 5.9 | 42 or less | B | 63 | B |
| Ex. 6 | 0.1 | 0.21 | 0.2 | 6.0 | Not measured | B | 57.31 | B |
| Ex. 7 | 0.1 | 0.23 | 0.2 | 6.9 | | B | 62.5 | B |
| Ex. 8 | 0.1 | 0.25 | 0.2 | 5.1 | | B | 54.69 | B |
| Comp. Ex. 1 | 0.5 | 1.3 | 0.2 | Drawing failed after chitosan was applied | | | | |
| Comp. Ex. 2 | 0.1 | 0.20 | 0.05 | Not measured | | | | |
| Comp. Ex. 3 | 0.1 | 0.28 | 1.0 | | | | | |
| Comp. Ex. 4 | 0.1 | 0.24 | 0.2 | 5.8 | Not measured | C | 47.44 | C |

As can be seen from Table 1, the acrylic fibers of the Examples had favorable antibacterial properties, and had favorable gloss. Also, the acrylic fibers of Examples 2 to 5, in which the content of chitosan extracted with diluted acetic acid was 0.05% by weight or more or the content of chitosan extracted with concentrated hydrochloric acid was 0.1% by weight or more, had an isovaleric acid volatilization amount of 70 μg or less per kilogram of the fibers, and also had favorable odor resistance.

On the other hand, in Comparative Example 1, in which the content of chitosan extracted with diluted acetic acid exceeded 0.4% by weight or the content of chitosan extracted with concentrated hydrochloric acid exceeded 1.2% by weight, drawing failed after chitosan was applied, and process stability was poor. In Comparative Example 2, in which the oil adhesion amount was less than 0.10% by weight, static electricity was generated, and thus process stability and processability were poor. In Comparative Example 3, in which the oil adhesion amount exceeded 0.90% by weight, separability of fiber bundles was poor and processability was poor. In Comparative Example 4, in which polyoxyethylene sorbitan fatty acid ester having an HLB of 11 was used, gloss was poor.

The present invention preferably includes at least embodiments below, but are not limited thereto.

[1] An antibacterial acrylic artificial hair fiber containing chitosan and a nonionic surfactant, in which a content of the chitosan extracted with diluted acetic acid is 0.005% by weight to 0.4% by weight, a content of the nonionic surfactant is 0.10% by weight to 0.90% by weight, the nonionic surfactant is one or more selected from the group consisting of a polyoxyethylene sorbitan fatty acid ester, a polyoxyethylene fatty acid monoester, and a polyoxyethylene alkyl ether, and the nonionic surfactant has an HLB of 13.0 or more.

[2] An antibacterial acrylic artificial hair fiber containing chitosan and a nonionic surfactant, in which a content of the chitosan extracted with concentrated hydrochloric acid is 0.014% by weight to 1.2% by weight, a content of the nonionic surfactant is 0.10% by weight to 0.90% by weight, the nonionic surfactant is one or more selected from the group consisting of a polyoxyethylene sorbitan fatty acid ester, a polyoxyethylene fatty acid monoester, and a polyoxyethylene alkyl ether, and the nonionic surfactant has an HLB of 13.0 or more.

[3] The antibacterial acrylic artificial hair fiber according to [1] or [2], in which the polyoxyethylene sorbitan fatty acid ester is one or more selected from the group consisting of polyoxyethylene sorbitan monooleate and polyoxyethylene sorbitan monolaurate.

[4] The antibacterial acrylic artificial hair fiber according to [1] or [2], in which the polyoxyethylene fatty acid monoester is polyoxyethylene monolaurate.

[5] The antibacterial acrylic artificial hair fiber according to [1] or [2], in which the polyoxyethylene alkyl ether is polyoxyethylene-(2-ethyl)hexyl ether.

[6] The acrylic artificial hair fiber for artificial hair according to any one of [1] to [5], in which an acrylic copolymer that constitutes the antibacterial acrylic artificial hair fiber contains acrylonitrile in an amount of 29.5% by weight to 79.5% by weight, one or more monomers selected from the group consisting of vinyl chloride and vinylidene chloride in an amount of 20% by weight to 70% by weight, and a sulfonic acid group-containing vinyl monomer in an amount of 0.5% by weight to 5% by weight.

[7] The antibacterial acrylic artificial hair fiber according to any one of [1] to [6], in which the antibacterial acrylic artificial hair fiber has a single fiber fineness of 10 to 150 dtex.

[8] The antibacterial acrylic artificial hair fiber according to any one of [1] to [7], in which an antibacterial activity value measured in accordance with JIS L 1902:2015 is 2.2 or more.

[9] The antibacterial acrylic artificial hair fiber according to any one of [1] to [8], in which the antibacterial acrylic artificial hair fiber has a gloss $L_{BNT}$ of 50.0 or more as defined by Bossa Nova Technologies.

[10] A hair ornament product containing the antibacterial acrylic artificial hair fiber according to any one of [1] to [9].

[11] The hair ornament product according to [10], in which the hair ornament product is one selected from the group consisting of a hair wig, a hairpiece, weaving hair, a hair extension, braided hair, a hair accessory, and doll hair.

[12] A method for producing the antibacterial acrylic artificial hair fiber according to any one of [1] to [9], the method including:

wet-spinning a spinning solution containing an acrylic copolymer, in which the chitosan and the nonionic surfactant are applied to the resulting filament before the filament is dried, and the nonionic surfactant has an HLB of 13.0 or more and is one or more selected from the group consisting of a polyoxyethylene sorbitan fatty acid ester, a polyoxyethylene fatty acid monoester, and a polyoxyethylene alkyl ether.

[13] The method for producing the antibacterial acrylic artificial hair fiber according to [12], the method including applying the chitosan and the nonionic surfactant to a wet-drawn filament.

[14] The method for producing the antibacterial acrylic artificial hair fiber according to [12] or [13], the method including applying the chitosan and the nonionic surfactant to a wet-drawn filament, drying the filament, and dry-drawing the filament.

The invention claimed is:

1. An antibacterial acrylic artificial hair fiber comprising:

chitosan; and a nonionic surfactant, wherein a content of the chitosan extracted with diluted acetic acid is 0.005% by weight to 0.4% by weight, or the content of the chitosan extracted with concentrated hydrochloric acid is 0.014% by weight to 1.2% by weight, a content of the nonionic surfactant is 0.10% by weight to 0.90% by weight, the nonionic surfactant is one or more selected from the group consisting of a polyoxyethylene sorbitan fatty acid ester, a polyoxyethylene fatty acid monoester, and a polyoxyethylene alkyl ether, and the nonionic surfactant has a hydrophilic-lipophilic balance (HLB) of 13.0 or more.

2. The antibacterial acrylic artificial hair fiber according to claim 1, wherein the polyoxyethylene sorbitan fatty acid ester is one or more selected from the group consisting of polyoxyethylene sorbitan monooleate and polyoxyethylene sorbitan monolaurate.

3. The antibacterial acrylic artificial hair fiber according to claim 1, wherein the polyoxyethylene fatty acid monoester is polyoxyethylene monolaurate.

4. The antibacterial acrylic artificial hair fiber according to claim 1, wherein the polyoxyethylene alkyl ether is polyoxyethylene-(2-ethyl)hexyl ether.

5. The antibacterial acrylic artificial hair fiber according to claim 1, further comprising:

an acrylic copolymer that contains acrylonitrile in an amount of 29.5% by weight to 79.5% by weight, one or more monomers selected from the group consisting of vinyl chloride and vinylidene chloride in an amount of 20% by weight to 70% by weight, and a sulfonic acid group-containing vinyl monomer in an amount of 0.5% by weight to 5% by weight.

6. The antibacterial acrylic artificial hair fiber according to claim 1, wherein the antibacterial acrylic artificial hair fiber has a single fiber fineness of 10 to 150 dtex.

7. The antibacterial acrylic artificial hair fiber according to claim 1, wherein an antibacterial activity value measured in accordance with Japanese Industrial Standards (JIS) L 1902: 2015 is 2.2 or more.

8. The antibacterial acrylic artificial hair fiber according to claim 1, wherein the antibacterial acrylic artificial hair fiber has a gloss $L_{BNT}$ of 50.0 or more as defined by Bossa Nova Technologies.

9. A hair ornament product comprising:

the antibacterial acrylic artificial hair fiber according to claim 1.

10. The hair ornament product according to claim 9, wherein the hair ornament product is one selected from the group consisting of a hair wig, a hairpiece, weaving hair, a hair extension, braided hair, a hair accessory, and doll hair.

11. A method for producing the antibacterial acrylic artificial hair fiber according to claim 1, the method comprising:

wet-spinning a spinning solution comprising an acrylic copolymer, wherein the chitosan and the nonionic surfactant are applied to the resulting filament before the filament is dried.

12. The method for producing the antibacterial acrylic artificial hair fiber according to claim 11, further comprising:

applying the chitosan and the nonionic surfactant to a wet-drawn filament.

13. The method for producing the antibacterial acrylic artificial hair fiber according to claim 12, further comprising:

after applying the chitosan and the nonionic surfactant to the wet-drawn filament, drying the filament and dry-drawing the filament.

14. The hair ornament product according to claim 9, wherein the polyoxyethylene sorbitan fatty acid ester is one or more selected from the group consisting of polyoxyethylene sorbitan monooleate and polyoxyethylene sorbitan monolaurate, the polyoxyethylene fatty acid monoester is polyoxyethylene monolaurate, and the polyoxyethylene alkyl ether is polyoxyethylene-(2-ethyl)hexyl ether.

15. The method for producing the antibacterial acrylic artificial hair fiber according to claim 11, wherein the acrylic copolymer comprises acrylonitrile in an amount of 29.5% by weight to 79.5% by weight, one or more monomers selected from the group consisting of vinyl chloride and vinylidene chloride in an amount of 20% by weight to 70% by weight, and a sulfonic acid group-containing vinyl monomer in an amount of 0.5% by weight to 5% by weight.

16. The method for producing the antibacterial acrylic artificial hair fiber according to claim 11, wherein the polyoxyethylene sorbitan fatty acid ester is one or more selected from the group consisting of polyoxyethylene sorbitan monooleate and polyoxyethylene sorbitan monolaurate, the polyoxyethylene fatty acid monoester is polyoxyethylene monolaurate, and the polyoxyethylene alkyl ether is polyoxyethylene-(2-ethyl)hexyl ether.

* * * * *